United States Patent [19]

Maekawa

[11] 3,986,530

[45] Oct. 19, 1976

[54] CLOTH HAVING ANTISTATIC PROPERTIES

[75] Inventor: Minoru Maekawa, Okayama, Japan

[73] Assignee: Kuraray Co., Ltd., Kurashiki, Japan

[22] Filed: June 25, 1975

[21] Appl. No.: 590,150

[30] Foreign Application Priority Data

July 31, 1974 Japan ..... 49-91620[U]
July 2, 1974 Japan ..... 49-78062[U]

[52] U.S. Cl. ..... 139/425 R; 57/139; 57/157 AS; 66/202; 428/922

[51] Int. Cl.[2] ..... D03D 15/02; D04B 21/14

[58] Field of Search ..... 139/425 R, 426 R; 66/202; 57/157 AS, 140 BY, 139; 317/2 C; 428/242, 922; 260/DIG. 15, DIG. 16; 427/304–306; 118/30

[56] References Cited

UNITED STATES PATENTS

| | | | |
|---|---|---|---|
| 3,288,175 | 11/1966 | Yalko | 139/425 R |
| 3,582,448 | 6/1971 | Okuhashi et al. | 428/242 |
| 3,586,597 | 6/1971 | Okuhashi et al. | 57/157 AS |
| 3,666,550 | 5/1972 | Okuhashi et al. | 428/922 X |
| 3,686,019 | 8/1972 | Ohfuka et al. | 427/304 |
| 3,699,590 | 10/1972 | Webber et al. | 139/425 R |
| 3,838,983 | 10/1974 | Brown et al. | 139/425 R |
| 3,864,148 | 2/1975 | Maekawa et al. | 118/305 X |
| 3,882,667 | 5/1975 | Barry | 57/157 AS |

*Primary Examiner*—James Kee Chi
*Attorney, Agent, or Firm*—Oblon, Fisher, Spivak, McClelland & Maier

[57] ABSTRACT

A knitted or woven cloth having antistatic properties which is suitable for use in the preparation of filter bags and garments, which is characterized in that said cloth contains an electrically conductive thread composed of 10 to 90 weight % of electroless metal plated staple fibers, and 90 to 10 weight % of metallic filaments, in an amount of 0.1 to 1.0 thread per cm width of the cloth.

12 Claims, 2 Drawing Figures

CLOTH HAVING ANTISTATIC PROPERTIES

BACKGROUND OF THE INVENTION

1. Field of the Invention

The present invention relates to a knitted or woven cloth having antistatic properties which is suitable for use in the preparation of filter bags or garments. More particularly, this invention relates to a knitted or woven cloth which contains an electrically conductive thread composed of 10 to 90 weight % of electroless metal plated staple fibers, and 90 to 10 weight % of metallic filaments, in a specific amount.

2. Description of Prior Art

When large quantities of electrically chargeable powdered materials, such as certain powdered high polymers or certain powdered inorganic materials, are handled, or when such materials are treated under high speeds, their characteristic of picking up static electricity can cause processing difficulties.

For instance, in certain chemical filtering operations, in which powdered particles are brought into mutual frictional contact, or into frictional contact with the filter bag, the build-up of static electricity can be so great, that static electricity discharge can cause severe shocks to workers, or can cause dust explosions. In other instances, the build-up of electrical charges in the particles or on the filter bag can impede the filtering operation.

Another instance of difficulties which can be caused by the accumulation of static electrical charges is in certain coating processes, such as in the manufacture of kraft papers. Again, shocks due to static electricity discharge can be annoying or injurious to workers or, in severe instances, can induce explosions. In this instance, the static electricity build-up is caused by the frictional movement of the work product beneath the coating apparatus, such as the feed rollers.

There is a need, therefore, for a means of removal of static electrical charges during such chemical processing.

In U.S. Pat. No. 3,288,175, it is suggested to solve the static electricity problem in such processes, by carrying out the processes in contact with a cloth containing metallic fibers. The use of such cloth as the filter medium, or as the base or surface of the feed rolls in contact with the work being coated, however, has not proven to provide adequate antistatic properties.

It is also known from U.S. Pat. No. 2,845,962, to provide an antistatic textile by the use of fibers which contain carbon black dispersed therein, and thus which are electrically conductive. However, in this case, the desired conductivity cannot be obtained unless a substantial amount of carbon black is dispersed throughout the interior of the fiber, which has the effect of reducing the mechanical strength of the fiber and rendering it susceptible to rupture during use.

Another prior art proposal was to incorporate into the cloth a small amount of electrically conductive fibers which had been prepared by coating the fiber with a resinous matrix and finely divided silver or carbon black (U.S. Pat. No. 3,586,597). However, this expedient also has been found to provide insufficient antistatic properties.

A need continues to exist, therefore, for an antistatic cloth which can be used in the preparation of filter bags or garments, which is characterized by a high level of antistatic properties, and which is characterized by good strength properties.

SUMMARY OF THE INVENTION

Accordingly, it is one object of this invention to provide a knitted or woven cloth having excellent antistatic properties, which can be used in the preparation of filter bags or garments.

These, and other objects of this invention, as will hereinafter become more readily apparent from the following description, have been attained by providing a knitted or woven cloth having antistatic properties which can be used in the preparation of filter bags or garments, which is characterized in that the cloth contains an electrically conductive thread composed of 10 to 90 weight % electroless metal plated staple fibers, and 90 to 10 weight % of metallic filaments, in an amount of 0.1 to 1.0 thread per cm width of the cloth.

DETAILED DESCRIPTION OF PREFERRED EMBODIMENTS

Figure 1:
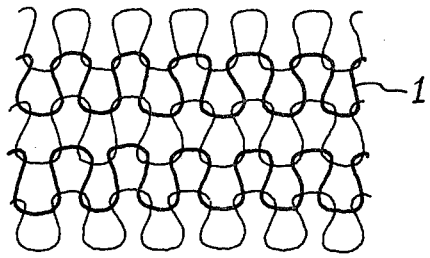
FIG. 1 shows a knit fabric with electrically conductive threads.
Figure 2:
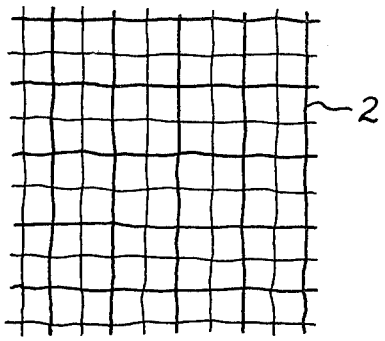
FIG. 2 shows a woven fabric having electrically conductive threads.

The electroless metal plated staple fibers incorporated into the electrically conductive thread used in this invention comprises a substrate of a chemical fiber, which is coated by electroless deposition, with an electrically conductive metal plate, and has the functional properties of a textile fiber. One method for preparing such electroless metal plated fibers is disclosed and claimed in U.S. Pat. No. 3,864,148. According to that disclosure, the fibers to be metal plated are subjected to such pre-treatments as deoiling, etching, and activation. Thereafter, the fibers so treated are contacted with an electroless plating solution containing metallic ions, reducing agents, complexing agents, hydrogen ion-adjusting agents, stabilizers and/or other additives.

There is no particular criticality in the chemical fibers which are subjected to the electroless deposition and a wide variety of different fibers are suitable. For instance, one may use synthetic resin fibers such as polyamide fibers, polyester fibers, polyolefin fibers, polyvinyl alcohol fibers, polyacrylonitrile fibers, acetate fibers and rayon fibers and natural fibers, such as cotton and wool fibers. Most preferred, however, are the polyvinyl alcohol fibers, because the electroless metal plate can be quite tenacious adhered to such fibers even without the use of an etching pre-treatment. In contrast, an etching pre-treatment is indispensable for the other fibers, since without such a pre-treatment, an adequately durable bond between the metal plate and the fibers cannot be obtained.

The form of the fibers to be metal plated is not critical and may be, for instance, monofilament, multi-filament yarn, staples or staple yarn (spun yarn). However, in the case of monofilament and multi-filament yarn, they should be cut into staple forms having an average fiber length of about 20 to 100 mm.

It is desirable for the denier of the individual filaments of the fibers to be metal plated to be from 0.1 to 9, especially from 1 to 4. If the fiber denier is less than 0.1, although a highly durable bond between the plating layer and the fibers can be obtained, the inherent flexibility of the fibers will be lost when the metal is placed in a thickness of about 1 $\mu$, and the surface area per unit weight will be increased. An increase in surface area per unit weight is economically disadvantageous. On the other hand, when the fibers have a denier exceeding 9, the durability of the bond between the plating layer and the fibers is reduced because of swelling and expansion of the fibers which occurs during plating, or due to shrinkage of the fibers caused during drying or cooling. Furthermore, cracks will be readily formed in the metal plating layer due to mechanical deformation or the like. In addition, plated fibers derived from fibers having a denier exceeding 9, will exhibit only an unacceptable antistatic activity. For these reasons, it is not desirable to use fibers having a filament denier exceeding 9.

A wide variety of metals may be electrolessly plated onto the fibers. As exemplary of suitable metals, may be mentioned nickel, copper, cobalt, chromium, tin, or the like. The metal may be used singly, or in the form of mixtures of two or more metals (for instance, a mixture of nickel and cobalt). In view of the stability of the plating solution and the rate of the plating reaction, use of nickel and copper, and especially nickel, is most preferred. If desired, an electrolytic metal plate may be formed over the electroless metal plated layer.

The metal plated fibers used in this invention will usually have a metal layer thickness of from 0.01 to 5.0 $\mu$, and preferably a thickness of from 0.5 to 0.1 $\mu$.

The electroless metal plated fibers are then combined with metallic filaments to prepare the electrically conductive thread. The metallic filaments should have a diameter of from 50 microns to 8 microns, preferably from 15 $\mu$ to 25 $\mu$. Above 50 $\mu$, the resulting thread will not possess good antistatic properties. Below 8 $\mu$, manufacturing difficulties can occur.

Combination of the metal plated fibers with the metallic filaments can be accomplished by any of various techniques. For example, the metallic filaments may be plied or doubled with the spun yarn of electroless metal plated fibers.

In short, the present invention is characterized by both the structure and incorporation density of the electrically conductive thread. It is indispensable that the structure of the electrically conductive thread should be such that it comprises 10 to 90 weight % of electroless metal plated staple fibers, and 90 to 10 weight % of metallic filaments. Preferably, the thread will comprise 30 to 70 weight % of electroless metal plated staple fibers, and 70 to 30 weight % of metallic filaments. When the ratio of electroless metal plated staple fibers to metallic filaments is outside this range, even if the incorporation density of the thread is in an amount of 0.1 to 1.0 thread per cm width of the cloth, it is impossible to completely prevent electrostatic difficulties. Moreover, when electroless metal plated filaments are used instead of electroless metal plated staple fibers, or instead of metallic filaments, or if the ratio of electroless metal plated staple fibers to metallic filaments is outside the above range, even if the electrically conductive thread is incorporated in an amount of 0.1 to 1.0 thread per cm width of the cloth, it will be impossible to provide adequate antistatic properties to the extent that both sparks and shocks are eliminated.

In the present invention, it is indispensable that the electrically conductive thread should be knitted or woven in an amount of 0.1 to 1.0 per cm width of the cloth, and preferably 0.4 to 1.0 thread per cm width of the cloth. If the incorporation density of the electrically conductive thread is outside this range, the intended objects of the present invention will not be attained. In particular, if the electrically conductive thread is incorporated in an amount larger than the above range, while technical common sense might indicate that spark and shock control would be expected to be enhanced, in fact, the experimental evidence does not support this expectation.

Having generally described the invention, a more complete understanding can be obtained by reference to certain specific Examples, which are provided for purposes of illustration only and are not intended to be limiting unless otherwise specified. In these Examples, polyacrylonitrile fibers (A) were used as the electrically conductive staple fibers. These fibers had a nickel coating of various thickness electrolessly metal plated, onto its surface. Various fiber lengths and deniers were used. Copper filaments (B), having a diameter of 20 $\mu$, were used as the metallic filaments. The electrically conductive threads were formed as indicated in the following Table 1, and the threads were incorporated in a knitted cloth as mentioned in the same Table to prepare a filter bag fabricated mainly of polyester fibers. A polyvinyl chloride powder having an average particle size of 50 $\mu$ was filtered through a filter bag, and the electrification voltage on the filter bag, the electrification voltage of dust from the polyvinyl chloride powder, and the pressure loss in the filter bag, were determined to obtain the results shown in the same Table. In each Example, the filter bag of the present invention was electrostatically grounded.

Table 1

| Example No. | Properties of A | | | Structure of Electrically Conductive Thread (weight %) | | Amount Incorporated of Electrically conductive Thread (thread/cm width)*1 | Absolute Electrification Voltage of Filter bag (KV) | Absolute Electrification Voltage of Powder (KV) | Pressure Loss (mm $H_2O$) |
|---|---|---|---|---|---|---|---|---|---|
| | denier (d) | length (mm) | coating thickness ($\mu$) | A | B | | | | |
| 1 | 1.5 | 57 | 0.2 | 50 | 50 | 1.0 | 0 | 0.2 | 41 |
| 2 | 2.0 | 57 | 0.2 | 45 | 55 | 0.4 | 0 | 0.5 | 40 |
| 3 | 1.5 | 45 | 0.2 | 55 | 45 | 0.2 | 0.3 | 1.2 | 52 |
| 4 | 1.5 | 57 | 0.3 | 50 | 50 | 0.1 | 1.5 | 2.8 | 60 |
| 5 | — | — | — | 0 | 0 | 0 | 53 | 25 | 130 |
| 6 | 1.5 | 57 | 0.2 | 50 | 50 | 0.075 | 12 | 7.9 | 95 |
| 7 | 1.5 | 57 | 0.25 | 100 | 0 | 0.12 | 5.5 | 4.7 | 74 |
| 8 | 1.5 | 57 | 0.25 | 0 | 100 | 0.12 | 8.8 | 7.6 | 97 |
| 9 | 1.5 | 57 | 0.2 | 95 | 5 | 0.15 | 4.9 | 3.5 | 73 |
| 10 | 1.5 | 57 | 0.2 | 3 | 97 | 0.15 | 7.3 | 5.8 | 85 |
| 11 | 2.0 | filament | 0.2 | 45 | 55 | 0.4 | 9.1 | 7.8 | 81 |
| 12 | 1.5 | 45 | 0.2 | 55 | 45(staples) | 0.2 | 5.5 | 4.0 | 70 |

Table 1-continued

| Example No. | Properties of A | | | | Structure of Electrically Conductive Thread (weight %) | Amount Incorporated of Electrically conductive Thread (thread/cm width)*1 | Absolute Electrification Voltage of Filter bag (KV) | Absolute Electrification Voltage of Powder (KV) | Pressure Loss (mm $H_2O$) |
|---|---|---|---|---|---|---|---|---|---|
| 13 | 1.5 | 45 | 0.007 | 55 | 45 | 1.0 | 10.3 | 7.9 | 96 |
| 14 | 1.5 | 45 | 5.2 | 55 | 45 | 0.2 | 0.2 | 1.2 | 47*2 |
| 15 | 1.5 | 57 | 0.2*3 | 50 | 50 | 1.0 | 4.0 | 3.3 | 68 |

*1The weight % of the electrically conductive thread to the knitted cloth is between about 0.1 and 2 %.
*2The antistatic properties in the filter bag of Example No. 14 were as excellent as those formed according to the present invention, but in that Example various problems were observed in the incorporation of the thread into the knitted cloth in the preparation of filter bags.
*3binder with carbon black, belonging to U.S. Pat. No. 3,586,597.

As is apparent from the results shown in the above Table, the filter bags of the present invention, which contain the electrically conductive thread (Examples 1 to 4), provide excellent and durable antistatic properties and they can be used in filter procedures without electrification of the particles being filtered. Further, the amounts of particles sticking to the filter bag (in direct proportion to the pressure loss) can be reduced. Thus, it has been confirmed that excellent and durable antistatic effects can be attained in the present invention. In contrast, in filter bags which do not satisfy any of the requirements of the structure and amount of the electrically conductive thread specified in the present invention, the intended objects of the present invention cannot be attained. Other Examples of the present invention will now be described.

Polyvinyl alcohol staple fibers having an electroless nickel plated coating of a thickness of 0.1 $\mu$ and a fiber length of 50 mm were used as the electrically conductive staple fibers, and stainless steel filaments of a diameter of 15 $\mu$ were used as the metallic filaments. The electrically conductive threads are formed as mentioned in the following Table 2. These threads were incorporated into a woven cloth as indicated in the same Table to prepare a garment fabricated mainly from cotton threads. Ten workers wore garments formed by incorporating an electrically conductive thread composed of these metal plated staple fibers and stainless steel filaments, and the frequency of spark and shock occurrance was observed at the final coating step in the manufacture of kraft paper. Also, wear and feel were tested. The results obtained are shown in the same Table. The evaluation was made according to the following rating:

A: no sparks or shocks
B: few sparks or shocks
C: moderate amount of sparks or shocks
D: sparks and shocks were very frequent In each Example, the garment prepared with the thread of the present invention was electrostatically grounded.

Table 2

| Example No. | Structure of Electrically Conductive Thread | Amount Incorporated of Electrically Conductive Thread (thread/cm width) | Sparks | Shocks | Wear and Feel |
|---|---|---|---|---|---|
| 16 | plated staple fiber:Metallic filament = 50 %:50 % | 1.0 | A | A | good |
| 17 | plated staple fiber-Metallic filament = 50 %:50 % | 1.5 | C | A | good |
| 18 | plated staple fiber:Metallic filament = 50 %:50 % | alternately arranged with cotton thread (15) | E | A | hard |
| 19 | plated staple fiber:metallic filament = 50 %:50 % | 0.5 | B | A | good |
| 20 | plated staple fiber:metallic filament = 50 %:50 % | 0.07 | C | C | good |
| 21 | plated filament:metallic filament = 50 %:50 % | 0.9 | C | A | good |
| 22 | plated staple fiber:metallic staple fiber=50 %:50 % | 1.0 | A | C | good |
| 23 | 100 % of plated staple fiber | 1.0 | A | C | good |
| 24 | 100 % of metallic filaments | 1.0 | C | C | good |
| 25 | 100 % of plated staple fibers | 100 % (all of cloth) | A | A | very hard |
| 26 | plated staple fiber:metallic filament = 10 %:90 % | 1.0 | A | A | good |
| 27 | plated staple fiber:metallic filament = 5 %:95 % | 1.0 | C | A | good |

As is apparent from the results shown in the above Table, for the garments of the present invention which contain the electrically conductive threads (Examples 16, 19 and 26), the occurrence of sparks or shocks were effectively reduced, and the wear and feel of the garments produced were as good as those of ordinary garments composed of cotton threads. In contrast, in comparable garments in which the requirements of structure and density of incorporation of the electrically conductive thread specified in the present invention were not satisfied, the intended objects of the present invention could not be attained.

The garments produced according to this invention will find application in the petrochemical industries (petroleum refinery, tanker, gas station, etc.), ship building industries, painting work of automobile industries and industries of coal, electric power, gas and chemicals, where the workers must handle, or work with ignitable materials.

Having now fully described the invention, it will be apparent to one of ordinary skill in the art that many changes and modifications can be made thereto without departing from the spirit or scope of the invention as set forth herein.

What is claimed as new and desired to be secured by Letters Patent is:

1. A knitted or woven cloth having antistatic properties, which is characterized in that said cloth contains an electrically conductive thread composed to 10 to 90 weight % of an electroless metal plated natural or synthetic resin staple fiber and 90 to 10 weight % of metallic filaments in an amount of 0.1 to 1.0 thread per cm width of the cloth.

2. The cloth according to claim 1, wherein the electroless metal plated staple fiber comprises a substrate of a synthetic resin fiber onto which a metal coating is electrolessly plated thereon in a thickness of 0.01 to 5.0 $\mu$.

3. The cloth according to claim 1, wherein the electrically conductive thread is composed of 30 to 70 weight % of electroless metal plated natural or synthetic resin staple fibers and 70 to 30 weight % of metallic filaments.

4. The cloth according to claim 1, wherein the electrically conductive thread is incorporated into the cloth in an amount of 0.4 to 1.0 thread per cm width of the cloth.

5. The cloth according to claim 2, wherein the thickness of the electroless metal plated coating is 0.05 to 1.0 $\mu$.

6. The cloth according to claim 2, wherein the denier of the synthetic resin fiber is 0.1 to 9 denier.

7. The cloth according to claim 6, wherein the denier of the synthetic resin fiber is 1 to 4 denier.

8. The cloth according to claim 2, wherein the synthetic resin fiber is polyvinyl alcohol fiber.

9. The cloth according to claim 2, wherein the metal is nickel.

10. The cloth according to claim 2, wherein the metallic filament is stainless steel filament.

11. The cloth according to claim 5, wherein the synthetic resin fiber is polyvinyl alcohol fiber.

12. The cloth according to claim 11, wherein the metal is nickel.

* * * * *